United States Patent [19]

Ford

[11] Patent Number: 4,791,796

[45] Date of Patent: Dec. 20, 1988

[54] TOOL FOR COLD FORGING TUBULAR MEMBERS

[75] Inventor: David L. Ford, Houston, Tex.

[73] Assignee: Cameron Iron Works USA, Inc., Houston, Tex.

[21] Appl. No.: 114,422

[22] Filed: Oct. 28, 1987

[51] Int. Cl.[4] ..... B23D 17/00

[52] U.S. Cl. ..... 72/62; 72/58; 29/421.1

[58] Field of Search ..... 72/56, 58, 62, 63; 29/42 R, 523, 727; 425/DIG. 19

[56] References Cited

U.S. PATENT DOCUMENTS

| | | | |
|---|---|---|---|
| 2,997,093 | 8/1961 | Harris | 72/63 |
| 3,343,916 | 3/1969 | Fisher et al. | 29/516 |
| 4,330,144 | 5/1982 | Ridenour | 29/523 |
| 4,382,373 | 5/1983 | Pettersson | 72/63 |
| 4,388,752 | 6/1983 | Vinciguerra et al. | 29/421 R |
| 4,608,739 | 9/1986 | Miller | 72/58 |
| 4,662,663 | 5/1987 | Schmitz | 29/523 |
| 4,724,693 | 2/1986 | Tedder | 29/421 R |

FOREIGN PATENT DOCUMENTS

| | | | |
|---|---|---|---|
| 810219 | 3/1959 | United Kingdom | 72/62 |

*Primary Examiner*—David Jones

*Attorney, Agent, or Firm*—Vinson & Elkins

[57] ABSTRACT

An improved cold forging tool to exert radial forces outwardly to form a tubular member outwardly into an annular member which includes a central body having external recesses and external shoulders at each end, a resilient sleeve surrounding said central body and having its ends positioned within said external recesses, a passage through the central body to communicate between a pressure supply line connected to the end of the body and the interior of said resilient sleeve, and first and second dual segmented, expandable anti-extrusion ring positioned between the central expansion portion of said resilient sleeve and each of said shoulders, a resilient ring retaining each of said segmented rings in surrounding relationship to the ends of said resilient sleeve to prevent extrusion of the resilient sleeve during the forming of the tubular member and a shoulder on said body limiting the radial outward movement of the rings abutting the external body shoulders.

7 Claims, 3 Drawing Sheets

TOOL FOR COLD FORGING TUBULAR MEMBERS

BACKGROUND

The cold forging of a tubular member into an annular member such as a well hanger or a connector has been known in the past. The cold forging has also been used to form a tubular member into an annular connector in a remote location, such as in a subsea pipeline repair. This is shown in U.S. Pat. Nos. 3,432,916 and 4,330,144. U.S. Pat. No. 4,662,663 discloses the use of pressure compensating material between the two members being cold formed and such material prevents the buildup of pressure which would prevent the proper completion of the cold forming.

A tool previously used in this type of cold forging process is shown in U.S. Pat. No. 4,388,752. This tool includes an alloy shaft having a shoulder on one end and a ring surrounding the other end and a rubber tube expansion element surrounding the shaft with annular nylon rings engaging the ends of the rubber expansion element and alloy rings supporting the exterior of each of the nylon rings. The radial force is developed by the tool responsive to longitudinal force exerted on the expansion element. The nylon rings are provided to prevent extrusion of the rubber expansion element.

Other tools have been suggested which include a resilient tubular member which is exposed to hydraulic pressure internally and secured at its ends and is allowed to exert outward radial forces to cold forge a tubular member into the interior of an annular member.

Further, reference is directed to pending application Ser. No. 07/106,803, filed Oct. 13, 1987 which discloses a similar tool. The tool of this copending application is limited in the range of diameters which it can accommodate without subjecting the packing to extrusion through the annular spaces during the cold forging operations of the tool. Another prior pending application which discloses the use of a cold forming tool in a well bore is copending application Ser. No. 044,409, filed Apr. 30, 1987.

SUMMARY

The present invention relates to an improved cold forging tool to exert radial forces outwardly to form a tubular member outwardly into an annular member. The improved tool includes a central body having external recesses and external shoulders at each end and support means connecting into one end, a resilient sleeve surrounding said central body and having its ends positioned within said external recesses, a passage through the central body to communicate between a pressure supply means connected to the end of the body and the interior of said resilient sleeve, and first and second dual expandable segmented anti-extrusion rings positioned between the central expansion portion of said resilient sleeve and each of said shoulders, resilient means retaining said segmented rings in surrounding relationship to the ends of said resilient sleeve to prevent extrusion of the resilient sleeve during the forming of the tubular member and means limiting the radial outward movement of the outer of said segmented rings.

An object of the present invention is to provide an improved tool for cold forging a tubular member within an annular member which reliably prevents extrusion of the resilient sleeve even when forging high strength tubular steel members surrounding said resilient sleeve.

Another object is to provide an improved cold forging tool suitable for a variety of diameters within which it will operate properly and efficiently.

Still another object is to provide an improved cold forging tool for use in a well bore which has a wide range of diameters of tubular members which it can cold forge and can be subjected to high forging pressures without extrusion of the resilient sleeve.

BRIEF DESCRIPTION OF THE DRAWINGS

These and other objects and advantages are hereinafter set forth and explained with reference to the drawings wherein.

DESCRIPTION OF THE PREFERRED EMBODIMENT

Figure 1:
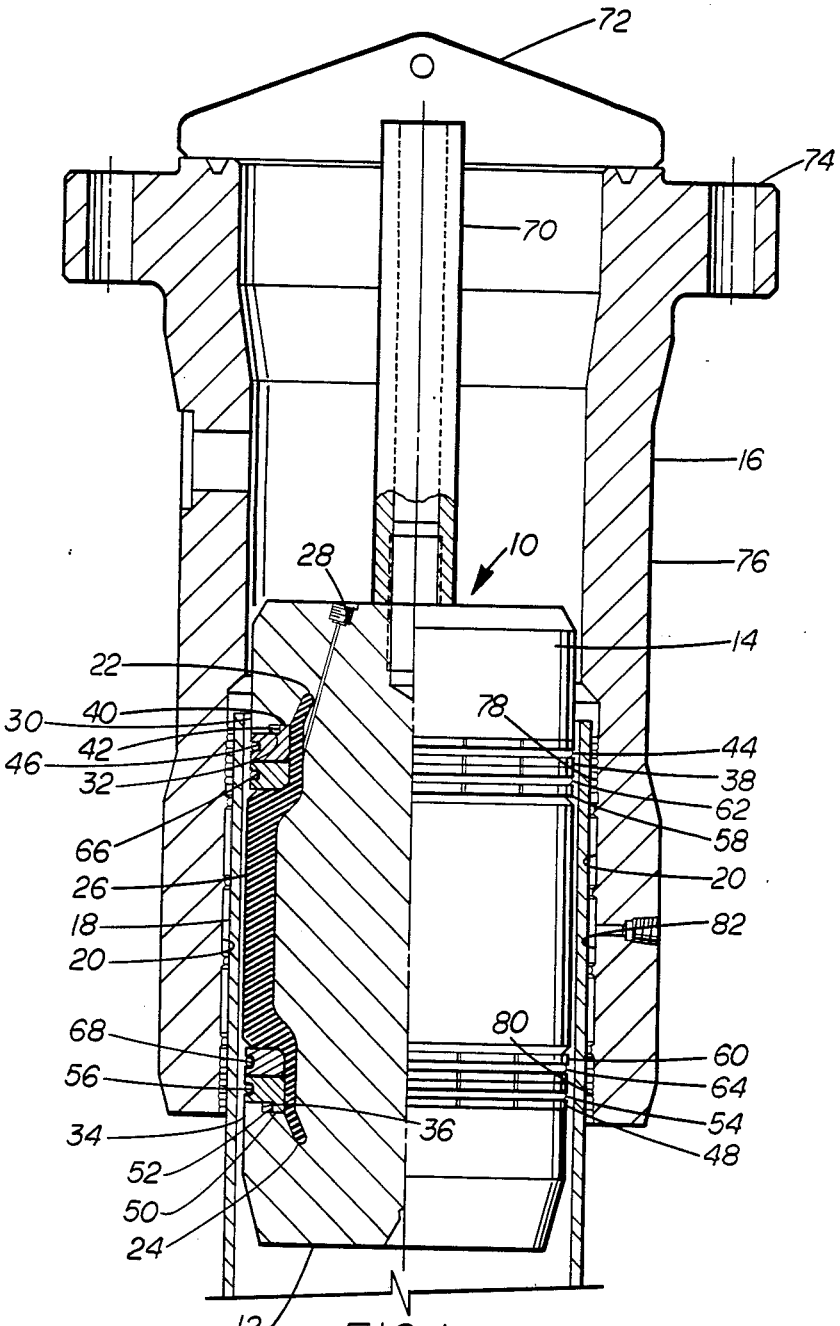
FIG. 1 is an elevation view partly in section of the tool of the present invention having a tubular member to be cold forged positioned in surrounding relationship thereto and with the annular member, into which the tubular member is to be forged, being connected to the tool and in surrounding relationship to the tubular member and the tool.

Improved cold forging tool 10 of the present invention, as best seen in FIG. 1, includes central body or mandrel 12 with packer assembly 14 being mounted thereon in surrounding relationship to the exterior of mandrel 12. Annular member 16 is suitably supported from tool 10 and has been lowered into a position so that the upper end of tubular member 18 which is to be forged into the interior of annular member 16 is within the upper portion of the contoured recess 20 within annular member 16.

Body or mandrel 12 includes upper and lower annular recesses 22 and 24 into which the upper and lower ends of resilient sleeve 26 is molded to leave the central or expansion portion of sleeve 26 free to expand radially outward responsive to hydraulic fluid under pressure delivered to its interior surface by passage 28 which extends through body 12 and is connected by fitting (not shown) or other suitable means to a source of pressurized hydraulic fluid.

Body 12 immediately at the outer opening of its upper annular recess 22 extends radially outward to axial flange 30 which forms a stop shoulder 32 on its inner surface as hereinafter explained. The lower end of body immediately at the outer opening of its lower annular recess 24 extends radially outward to axial flange 34 which forms a stop shoulder 36 on its inner surface as hereinafter explained.

Dual expandable anti-extrusion means are provided to prevent extrusion of the upper and lower portions of sleeve 26 between gaps which might exist without such anti-extrusion means. Each of the anti-extrusion means is made of segments of a metal ring as hereinafter explained.

Upper outer support segments 38 are positioned in a ring around the upper portion of resilient sleeve 26 and include flange 40 extending upward so that their outer faces 42 will be engaged by stop shoulder 32 on flange 30 to provide a stop for the radial outward movement of segments 38. A suitable resilient biasing means 44, such as a garter spring or an O ring, is positioned in grooves 46 in the exterior surfaces of segments 38 to urge segments 38 inwardly. Segments 38 are positioned to have their upper surfaces in engagement with the lower surface of flange 40 at all times. Lower outer support segments 48 are positioned in a ring around the lower portion of resilient sleeve 26 and include flange 50 extending downward so that their outer faces 52 will be engaged by stop shoulder 36 on flange 34 to provide a stop for the radial outward movement of segments 48. A suitable resilient biasing means 54, such as a garter spring or an O ring, is positioned in grooves 56 in the exterior surfaces of segments 48 to urge segments 48 inwardly. Segments 48 are positioned to have their lower surfaces in engagement with the upper surface of flange 50 at all times.

Inner segments 58 and 60 are positioned around the upper and lower portions of resilient sleeve 26 in abutting relationship with the lower surfaces of upper segments 38 and with the upper surfaces of lower segments 48 as shown. Suitable biasing means 62 and 64 respectively, such as garter springs or O rings, are positioned in grooves 66 and 68 in the outer surfaces of segments 58 and 60.

Member 70 connects into the upper end of body 12 and also connects to bracket 72 which is suitably connected to support annular member 16 as it is being lowered into position around tubular member 18. Member 70 may extend to the surface to provide the string by which tool 10 and member 16 are lowered into position or some other suitable connecting means is provided.

Annular member 16 includes outer flanges 74 and a tubular body 76 with the lower interior of body 76 having a contoured recess 20. It is preferred that recess 20 include upper and lower threaded sections 78 and 80 and intermediate section 82 which includes alternate lands and grooves as shown.

Figure 3:
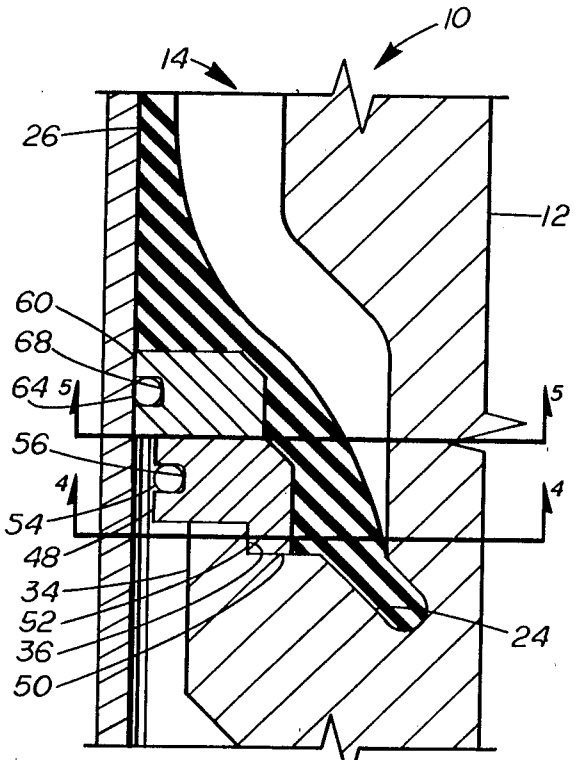
FIG. 3 is a partial detail sectional view of the improved tool in its forming position with the tubular member.
Figure 2:
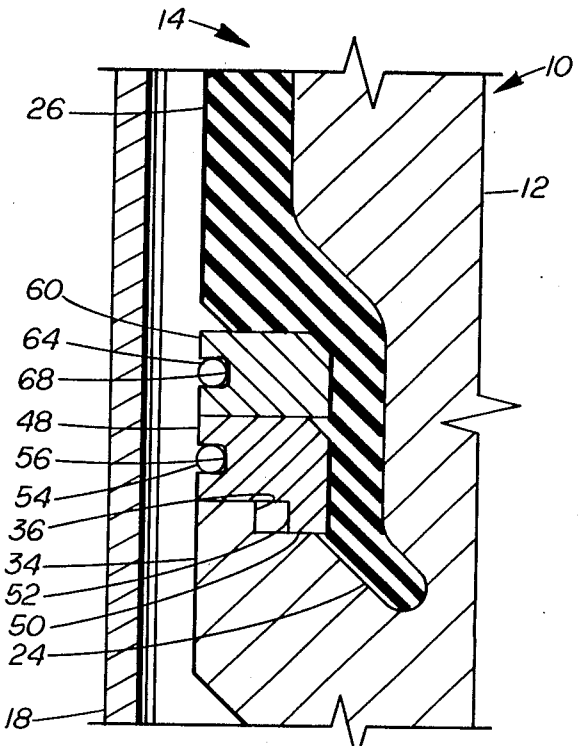
FIG. 2 is a partial detail sectional view of the improved tool in its relaxed position with the tubular member and the annular member being shown.
Figure 5:
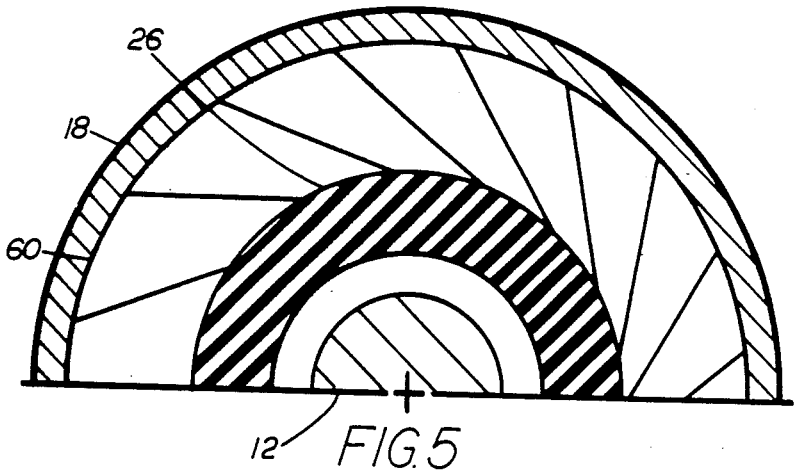
FIG. 5 is a sectional view taken along line 5—5 in FIG. 3.
Figure 4:
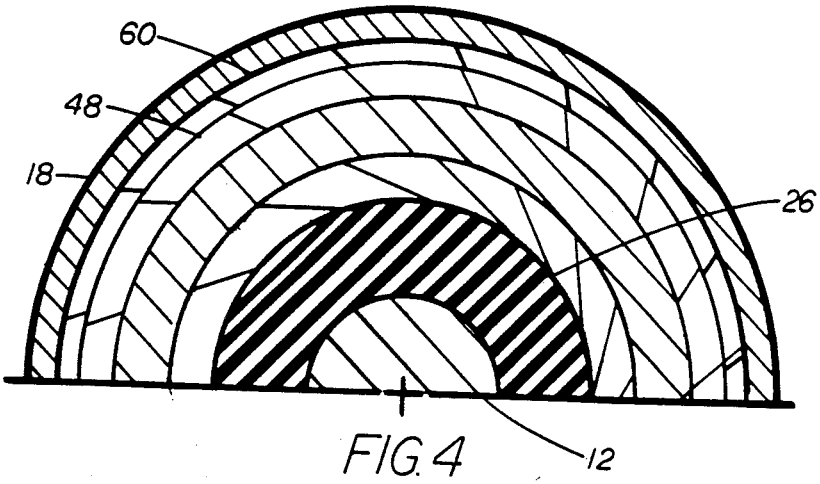
FIG. 4 is a sectional view taken along line 4—4 in FIG. 3.

With tool 10 and annular member 16 positioned with respect to tubular member 18 as shown in FIG. 1, pressure is delivered through passage 28 into the interior of resilient sleeve 26 so that it expand radially outward into contact with the interior of tubular member 18. Continued application of hydraulic pressure causes tubular member 18 to be cold forged into engagement within recess 20 of annular member 16. As resilient sleeve 26 commences its movement radially outward, segments 38, 48, 58 and 60 move radially outward in supporting relationship to the exterior of sleeve 26 and with the end faces of segments 38 and 48 being maintained in contact with the ends of flanges 30 and 34. Further, the abutting faces of segments 38 and 58 and the abutting faces of segments 48 and 60 are maintained in engage as can be seen in FIG. 3. When segments 38 and 48 have their flange surfaces 42 and 52 come into contact with stop shoulders 32 and 36, they are in their circular or outermost position as is shown in FIG. 4. Segments 58 and 60 continue to move outward as sleeve 26 continues to move and the exterior surfaces of segments 58 and 60 are maintained in contact with the interior surface of tubular member 18 to provide continuous support for sleeve 26 so that it does not have spaces available through which it could extrude. In their outermost positions as shown in FIG. 5, segments 58 and 60 form a substantially continuous ring as shown. When the segments are retracted they move inwardly responsive to the biasing means and assume a non-circular or irised position.

Segments 38, 48, 58 and 60 are preferably cut from a metal ring at angles to the radial direction or to explain in another manner they are cut along lines which are at an angle substantially less than ninety degrees to a tangent at the point of entry of the cut into the exterior surface of the metal ring as can be seen from FIG. 5. The outer diameter of the ring from which segments 58 and 60 are cut is preferred to be the maximum outer diameter to which they will be exposed in operations of tool 10. The outer diameter of the ring from which segments 38 and 48 are cut is preferred to be their outer diameter when they have engaged their respective stop shoulders.

The inclusion of the pair of support segment rings at each end of resilient sleeve 26 provides improved support to sleeve 26 over a much wider range of diameters than could be provided with the tools of the prior art. It is easily seen that the selection of the particular size of the rings from which the segments are cut should be done with care so that the best support can be provided at the smallest and the largest diameters of operations for which tool 10 is to be used.

What is claimed is:

1. A tool for forging tubular members comprising a cylindrical body having a passage extending from its upper end and exiting at an intermediate position on its outer surface, an upwardly facing shoulder surrounding the lower portion of said body, a short downwardly facing flange on the upper exterior of said body and having its inner surface spaced radially outward from the exterior of the body, a short upwardly facing flange on the lower exterior of said body and having its inner surface spaced radially outward from the exterior of the body, a packer assembly surrounding said body and including a resilient sleeve, means securing the ends of the sleeve in sealed relationship to the exterior of said body within said flanges, a first upper expandable anti-extrusion ring surrounding the upper end of said sleeve, a first lower expandable anti-extrusion ring surrounding the lower end of said sleeve, a second upper expandable anti-extrusion ring surrounding the upper end of said sleeve immediately abutting the lower surface of said first upper anti-extrusion ring, and a second lower expandable anti-extrusion ring surrounding the lower end of said sleeve immediately abutting the upper surface of said first lower anti-extrusion ring.

2. A tool according to claim 1 wherein each of said anti-extrusion rings includes a plurality of ring segments, said ring segments being shaped so that the rings have an irising action when moved radially, and means surrounding the ring segments and biasing said ring segments inwardly.

3. A tool according to claim 1 wherein each of said anti-extrusion rings includes a plurality of ring segments, said segments being shaped as though they were cut from a ring having the largest diameter which said segments are expected to assume when installed on said sleeve in its expanded condition and to form a relatively solid ring when expanded to their largest diameter, and means surrounding the ring segments and biasing said ring segments inwardly.

4. A tool according to claim 1 including means on said body shoulders coacting with said first upper and first lower expandable anti-extrusion ring to limit the radial outward travel of such rings.

5. A tool according to claim 4 wherein said travel limiting means includes an inwardly facing shoulder on each of said body shoulders, and an outwardly facing shoulder of said first upper and first lower rings which projects under and engages said inwardly facing shoulders on the body shoulders to limit the radial outward travel of said first rings.

6. A tool for forging tubular members comprising a cylindrical body, a resilient sleeve surrounding said body, means securing the ends of said sleeve to said body, means for delivering fluid under pressure to expand said sleeve, dual upper anti-extrusion means surrounding the upper end of said sleeve and coating to move outward with the expansion of the sleeve to close any gap through which said sleeve could extrude when exposed to internal pressure, and dual lower anti-extrusion means surrounding the lower end of said sleeve and coating to move outward with the expansion of the sleeve to close any gap through which said sleeve could extrude when exposed to internal pressure, said anti-extrusion means include expandable rings, the outer of each of said dual rings movable a limited distance outward, and the inner of each of said dural rings movable a greater distance outward than said outer rings, each of said rings include a plurality of ring segments, and means biasing said segments inwardly, said segments are cut from a metal ring having the largest diameter which said segments are expected to assume when installed on said sleeve, said segments when cut from their ring are cut at angles to the radius of the ring to allow said rings to have an irising action when moved to a smaller than their maximum desired diameter.

7. A tool for forging tubular members comprising a cylindrical body, a resilient sleeve surrounding said body, means securing the ends of said sleeve to said body, means for delivering fluid under pressure to expand said sleeve, dual upper anti-extrusion means surrounding the upper end of said sleeve and coating to move outward with the expansion of the sleeve to close any gap through which said sleeve could extrude when exposed to internal pressure, and dual lower anti-extrusion means surrounding the lower end of said sleeve and coating to move outward with the expansion of the sleeve to close any gap through which said sleeve could extrude when exposed to internal pressure, said anti-extrusion means include expandable rings, the outer of each of said dual rings movable a limited distance outward, and the inner of each of said dural rings movable a greater distance outward than said outer rings, each of said rings include a plurality of ring segments, and means biasing said segments inwardly, said segments are cut from a metal ring having the largest diameter which said segments are expected to assume when installed on said sleeve, said segments are cut from their ring along lines which are at an angle substantially less than ninety degrees to a tangent at the point of entry of the cut into the exterior surface of the metal ring.

* * * * *